US007510364B2

(12) United States Patent
Sakada

(10) Patent No.: US 7,510,364 B2
(45) Date of Patent: Mar. 31, 2009

(54) LOADING APPARATUS

(75) Inventor: Seiji Sakada, Okayama (JP)

(73) Assignees: Yanmar Co., Ltd., Osaka (JP); Yanmar Construction Equipment Co., Ltd., Fukuoka (JP)

( * ) Notice: Subject to any disclaimer, the term of this patent is extended or adjusted under 35 U.S.C. 154(b) by 210 days.

(21) Appl. No.: 11/569,486

(22) PCT Filed: Sep. 15, 2004

(86) PCT No.: PCT/JP2004/013453

§ 371 (c)(1),
(2), (4) Date: Nov. 21, 2006

(87) PCT Pub. No.: WO2005/113902

PCT Pub. Date: Dec. 1, 2005

(65) Prior Publication Data

US 2007/0217899 A1 Sep. 20, 2007

(30) Foreign Application Priority Data

May 21, 2004 (JP) ..... 2004-152152

(51) Int. Cl.
*E02F 3/00* (2006.01)

(52) U.S. Cl. ..... 414/685; 414/686; 414/700; 414/917

(58) Field of Classification Search ..... 414/680, 414/685, 686, 697, 700, 917
See application file for complete search history.

(56) References Cited

FOREIGN PATENT DOCUMENTS

| | | | |
|---|---|---|---|
| JP | 10-088622 | | 4/1998 |
| JP | 11286956 | | 10/1999 |
| JP | 2004-052250 | | 2/2004 |
| JP | 2004-143668 | A * | 5/2004 |

OTHER PUBLICATIONS

International Search Report for International Appl. No. PCT/JP2004/013453, Japanese Patent Office, mailed on Jan. 11, 2005 1 page.

* cited by examiner

*Primary Examiner*—Donald Underwood
(74) *Attorney, Agent, or Firm*—Sterne, Kessler, Goldstein & Fox P.L.L.C.

(57) ABSTRACT

A simple and compact loader having a sufficient strength with brackets fixed on a working vehicle. Lift arms are pivoted at one ends thereof to respective brackets so as to be vertically swung by respective lift arm cylinders. Attachments are vertically swingably supported on respective tip portions of the lift arms. Bucket links are connected to the respective attachments so as to transmit the telescopic action of bucket cylinders. Each of the bucket links is offset laterally from each of the lift arms. The middle portion of each of the lift arms is disposed above a straight line connecting both ends of the lift arm to each other, so as to ensure a space for arranging a steerable wheel under the lift arm.

1 Claim, 11 Drawing Sheets

(a)

(b)

(a)

(b)

LOADING APPARATUS

BACKGROUND OF THE INVENTION

1. Field of the Invention

The invention relates to a loading apparatus (loader) attached to a working vehicle so as to be used for loading sand, bulk and so on.

2. Background Art

Generally, a front loader, serving as a loading apparatus attached to a working vehicle, includes a pair of left and right lift arms, a bucket connected to tips of the lift arms, a cylinder for lifting the lift arms, and a cylinder for rotating the bucket.

A normal front loader disclosed in Japanese Laid Open Gazette No. Hei 8-27842 is attached onto brackets secured on left and right sides of a rear portion of a bonnet of a tractor, serving as a working vehicle. The tractor is provided with a cylinder for rotating the lift arms below the lift arms of the front loader, and is provided with a bucket link below the lift arms. An intermediate link is attached onto an upper portion of each of the lift arms. The bucket link extended from the bracket is connected through the intermediate link to a bucket cylinder, which is telescopically moved for swinging the bucket. In the front loader, having this construction disclosed in the document, the linkage for swinging the bucket is formed straight above the lift arms. The linkage for swinging the bucket of the front loader includes two rotatable members attached to each of the lift arms between the bucket and each of the brackets secured on the respective sides of the bonnet of the tractor, thereby being prevented from interfering with the lift arms.

To reduce the whole length of the working vehicle, including the front loader equipped on the vehicle, the pivot points of the lift arms are required to move toward the working vehicle, however, the lift arms have to be prevented from interfering with wheels of the working vehicle.

If the lift arms are curved to be prevented from interfering with the wheels, the intermediate link for relaying the action of the bucket cylinder has to be expanded so as to prevent the linkage for the bucket from interfering with the lift arms. The expansion of the intermediate link increases the weight of the loader, and narrows an operator's ken for viewing the bucket.

BRIEF SUMMARY OF THE INVENTION

Problem to Be Solved by the Invention

Problems to be solved are the interference of the lift arms with wheels and the expansion of the intermediate link caused when the working vehicle with the loader is minimized in the whole length.

Way for Solving the Problem

The invention solves the above problems by the following ways:

A loading apparatus according to the invention comprises: a bracket fixed on a vehicle; a lift arm pivoted at one end thereof onto the bracket; a lift arm cylinder interposed between the bracket and the lift arm and adapted to be telescoped for vertically swinging the lift arm relative to the bracket; an attachment vertically swingably pivoted onto a tip portion of the lift arm; an intermediate link pivoting an intermediate portion of the lift arm; a bucket cylinder interposed between the intermediate link and the attachment and adapted to be telescoped for vertically swinging the attachment relative to the lift arm; and a bucket link interposed between the intermediate link and the attachment so as to transmit the telescopic movement of the bucket cylinder to the attachment.

The bucket link is disposed above the lift arm. The intermediate link includes a pair of left and right plates, so that a rear end portion of the bucket link is pivoted to an upper front portion of the intermediate link between the plates, a tip portion of a piston rod of the bucket cylinder is pivoted to an upper rear portion of the intermediate link between the plates, and a fore-and-aft middle portion of the lift arm is pivoted to a bottom portion of the intermediate link between the plates. The lift arm is disposed at a lateral middle position between the plates of the intermediate link. The bucket link is offset laterally outward from the lift arm between the plates of the intermediate plates so as not to vertically overlap the lift arm. The lift arm and the bucket link are made of plates. A pair of left and right brackets are fixed on the vehicle. A pair of left and right bucket cylinders, a pair of left and right lift arms, and a pair of left and right lift arm cylinders are provided to the vehicle. Each of the bucket cylinders, each of the lift arms and each of the lift arm cylinders are pivoted at respective rear ends thereof to each of the brackets. In each of the brackets, a pivot center of the lift arm is disposed forward and downward from a pivot center of the bucket cylinder. In each of the brackets, a pivot center of the lift arm cylinder is disposed forward and downward from the pivot center of the lift arm. A stopper is provided on each of the lift arms so as to limit the rotation of a bucket attached to the attachment.

Effect of the Invention

According to the invention, a loading apparatus comprises: a bracket fixed on a vehicle; a lift arm pivoted at one end thereof onto the bracket; a lift arm cylinder interposed between the bracket and the lift arm and adapted to be telescoped for vertically swinging the lift arm relative to the bracket; an attachment vertically swingably pivoted onto a tip portion of the lift arm; an intermediate link pivoting an intermediate portion of the lift arm; a bucket cylinder interposed between the intermediate link and the attachment and adapted to be telescoped for vertically swinging the attachment relative to the lift arm; and a bucket link interposed between the intermediate link and the attachment so as to transmit the telescopic movement of the bucket cylinder to the attachment. The bucket link is disposed above the lift arm. The intermediate link includes a pair of left and right plates, so that a rear end portion of the bucket link is pivoted to an upper front portion of the intermediate link between the plates, a tip portion of a piston rod of the bucket cylinder is pivoted to an upper rear portion of the intermediate link between the plates, and a fore-and-aft middle portion of the lift arm is pivoted to a bottom portion of the intermediate link between the plates. The bucket link is offset laterally outward from the lift arm side. The lift arm and the bucket link are made of plates.

Therefore, the loading apparatus is simplified, expands an operator's ken for viewing a bucket or another member attached to the attachment, and ensures strengths of its components.

Further, since the lift arm is disposed at a lateral middle position between the plates of the intermediate link, and the bucket link is offset laterally outward from the lift arm between the plates of the intermediate plates so as not to vertically overlap the lift arm, the bucket link is prevented from interfering with the link arm during lifting and swinging of the bucket. Therefore, when the bucket link is operated for swinging the bucket, it is unnecessary to consider the prevention of interference of the bucket link with the lift arm, so that the freedom degree of designing the bucket link is enhanced and a large rotatable range of the bucket is ensured. The bucket link can be formed into a nearly rectilinear shape, such as to have sufficient rigidity and durability in comparison with a curved bucket link. As a result, the linkage for swinging the attachment is simplified with pivot points reduced in number, while ensuring a sufficient strength.

Further, since the lift arm and the bucket link are made of plates, the lateral width of the linkage of the loading apparatus is reduced so as to expand the sight for viewing the bucket attached to the attachment in the case where the linkage overlaps in side view by vertically moving the lift arm. Further, the loading apparatus is lightened at a side thereof toward the bucket, so as to reduce the moment applied onto the loading apparatus when the bucket is lifted up and down.

Further, a pair of left and right brackets are fixed on the vehicle. A pair of left and right bucket cylinders, a pair of left and right lift arms, and a pair of left and right lift arm cylinders are provided to the vehicle. Each of the bucket cylinders, each of the lift arms and each of the lift arm cylinders are pivoted at respective rear ends thereof to each of the brackets. In each of the brackets, a pivot center of the lift arm is disposed forward and downward from a pivot center of the bucket cylinder. In each of the brackets, a pivot center of the lift arm cylinder is disposed forward and downward from the pivot center of the lift arm.

Therefore, the linkages having the above-mentioned construction are disposed on left and right sides of the working vehicle.

Further, since a stopper is provided on each of the lift arms so as to limit the rotation of a bucket attached to the attachment, the structure of the lift arm with the stopper is simple, and the stopper provided on the lift arm is advantageous in durability. As a result, the structure of the loading apparatus including the lift arm is simple.

DESCRIPTION OF NOTATIONS

1 Working Vehicle
2 Loader
3 Excavator
4 Bracket
11 Lift Arm
12 Lift Arm Cylinder
13 Intermediate Link
14 Bucket Cylinder
15 Bucket Link
16 Reinforcing Member
18 Bucket
19 Attachment

DETAILED DESCRIPTION OF THE INVENTION

A loading apparatus attached to a working vehicle is configured so as to have a simple linkage for lifting and swinging an attachment, and to have a large workable range while preventing components of the linkage from interfering with each other.

EMBODIMENT 1

An embodiment of the invention will be described with reference to the drawings.

Figure 1:
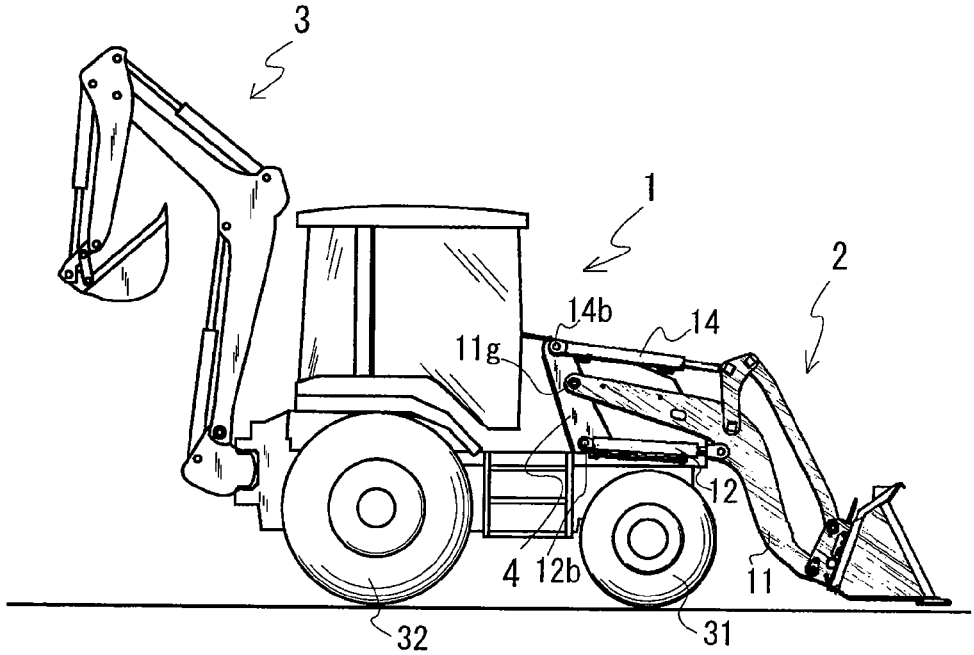
FIG. 1 is a side view of a loader attached to a working vehicle.

FIG. 1 is a side view of a loader attached to a working vehicle.

A working vehicle 1 is a backhoe loader, provided with front wheels 31 and rear wheels 32. Working vehicle 1 is equipped with a loader 2, serving as a loading apparatus, and an excavator 3. A pair of brackets 4 are disposed on respective left and right sides of a bonnet of working vehicle 1, and fixed to a body frame of working vehicle 1.

Loader 2 is attached to brackets 4 at a front portion of working vehicle 1 so as to serve as a front loader. On each bracket 4 are disposed a pivot center 11*g* for a lift arm 11, a pivot center 14*b* for a bucket cylinder 14 and a pivot center 12*b* for a lift arm cylinder 12. Pivot center 11*g* for lift arm 11 is disposed forward and downward from center pivot 14*b* for bucket cylinder 14. Pivot center 12*b* for lift arm cylinder 12 is disposed forward and downward from center pivot 11*g* for lift arm 11.

Working vehicle 1 includes steerable wheels below lift arms 11 of loader 2. Each of lift arms 11 is doglegged when viewed in side, so as to have a fore-and-aft middle portion above a straight line extended between both ends thereof, thereby ensuring a space therebelow for turning the steerable wheels.

A structure of loader 2 will be described.

Figure 2:
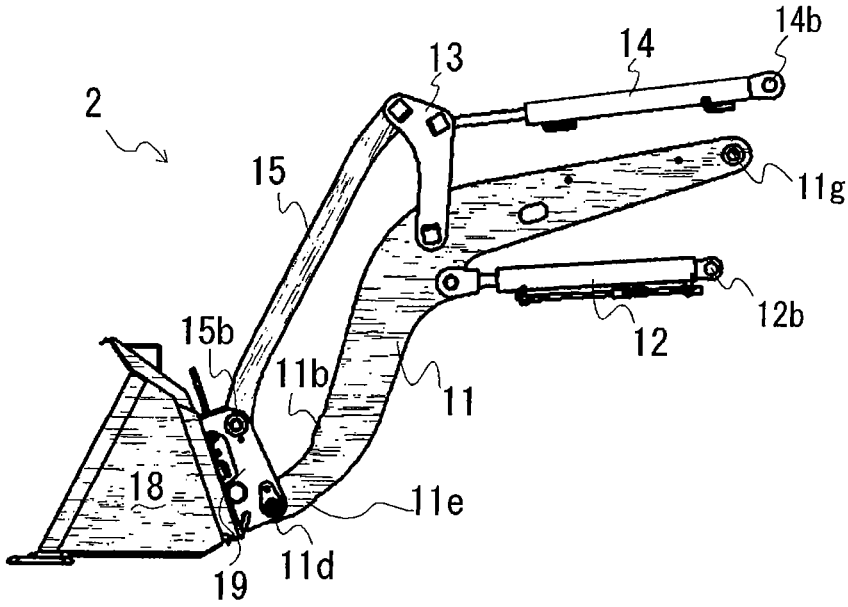
FIG. 2 is a side view of the loader.
Figure 3:
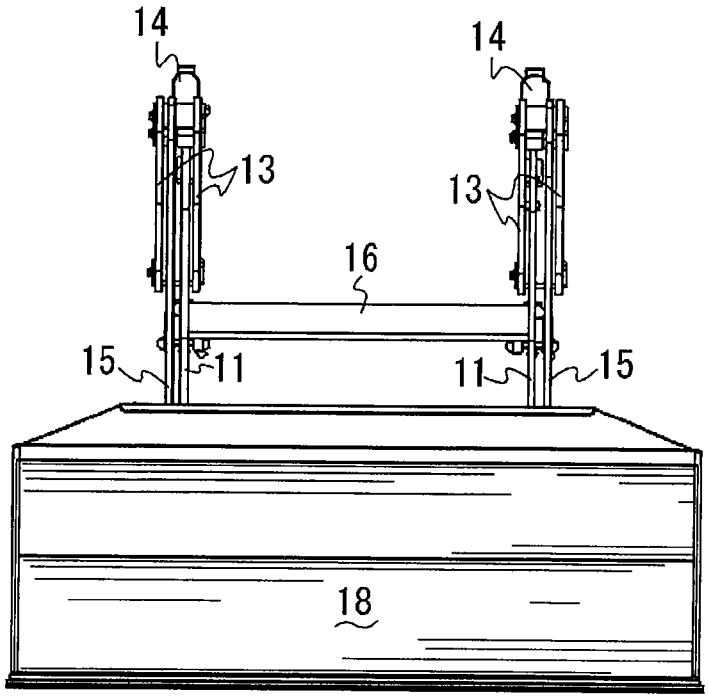
FIG. 3 is a front view of the loader.
Figure 4:
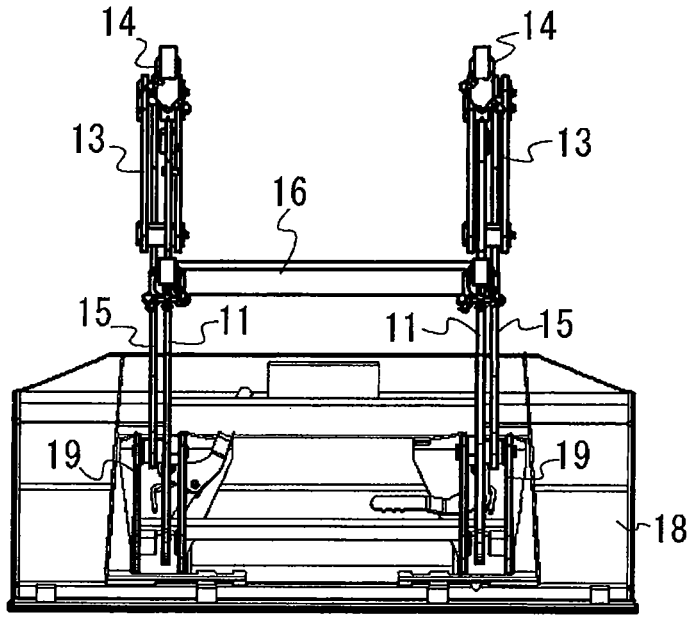
FIG. 4 is a rear view of the loader.
Figure 5:
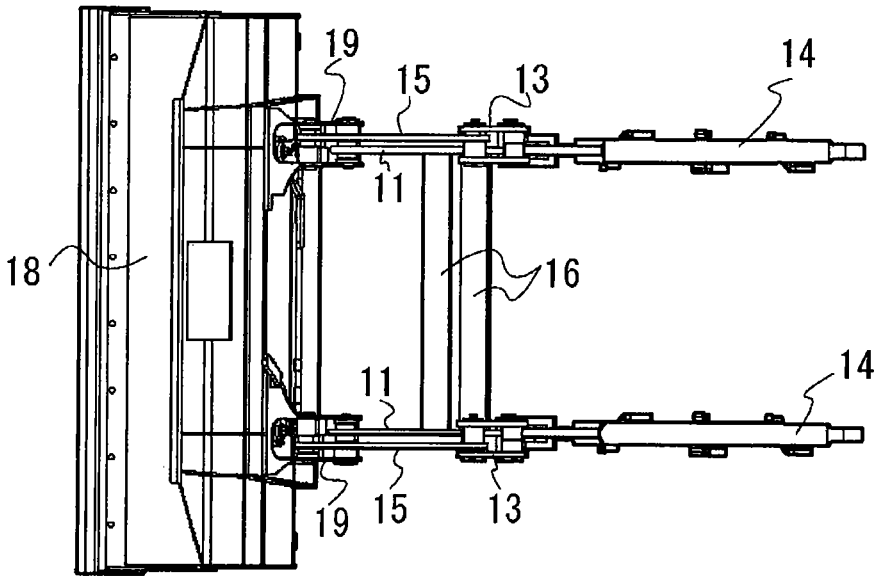
FIG. 5 is a plan view of the loader.
Figure 6:
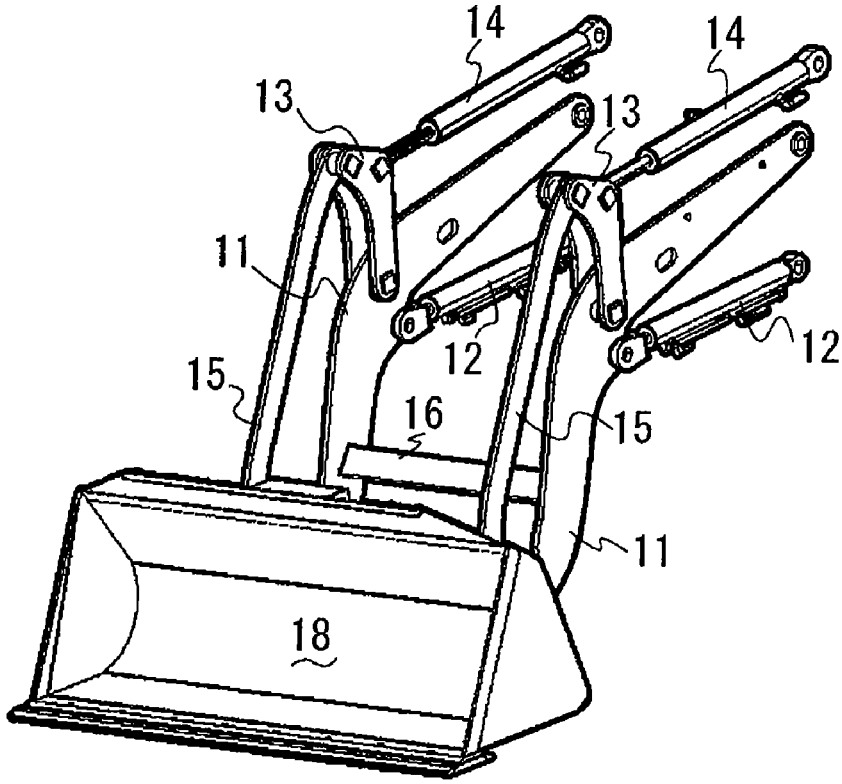
FIG. 6 is a perspective view of the loader.

FIG. 2 is a side view of the loader; FIG. 3 is a front view of the loader; FIG. 4 is a rear view of the loader; FIG. 5 is a plan view of the loader; and FIG. 6 is a perspective view of the loader.

Loader 2 includes lift arms 11, lift arm cylinders 12, a bucket 18, bucket links 15, intermediate links 13, bucket cylinders 14 and others.

Each of lift arms 11, each of bucket cylinders 14, and each of lift arm cylinders 12 are pivoted at rear ends thereof onto each of brackets 4.

Lift arms 11 are vertically rotated by respective lift arm cylinders 12. Bucket 18 is swung by bucket cylinders 14 connected to respective bucket links 15 through respective intermediate links 13.

The pair of lift arms 11 are disposed on respective left and right sides of working vehicle 1. Each of lift arms 11 is extended forwardly and downwardly slantwise in a side view, bent downward at the middle portion thereof, and bent forward at the lower front portion thereof, so as to be substantially S-shaped. Each of bucket cylinders 14, each of intermediate links 13 and each of bucket links 15 are disposed above each of lift arms 11. Each of lift arm cylinders 12 is disposed below each of lift arms 11. Bucket 18 is attached to tips of lift arms 11 through respective attachments 19.

Bucket cylinder 14 and lift arm cylinder 12 are spaced from corresponding lift arm 11, so that the space between bucket cylinder 14 and lift arm 11 and the space between lift arm cylinder 12 and lift arm 11 are adapted for disposing a device for preventing the corresponding members from falling, for instance. In this way, various devices can be disposed in the spaces to be attached to loader 2, while ensuring the compactness of loader 2.

Left and right lift arms 11 are connected at lower front portions thereof to each other through reinforcing members 16 so as to enhance the rigidity for supporting bucket 18. As shown in FIG. 5, front and rear reinforcing members 16 are disposed in parallel to each other and extended laterally so as to connect left and right lift arms 11 to each other. The pair of reinforcing members 16 increase effective sectional areas for ensuring the rigidity, thereby serving as a simple and light structure for improving the rigidity of supporting bucket 18.

A back surface of bucket 18 is adapted to be attached or detached to and from attachments 19. Each of attachments 19 is swingably pivoted onto corresponding lift arm 11 through a connection pin 11*d*. Each of bucket links 15 is pivoted at a tip thereof onto an upper portion of corresponding attachment 19 through a connection pin 15*b*. Therefore, bucket 18 is swung together with attachments 19 by moving bucket links 15 relative to lift arms 11.

Each of intermediate links 13 is pivoted at a lower end portion thereof onto the fore-and-aft middle portion of corresponding lift arm 11. Each of bucket links 15 is pivoted at a rear end thereof to an upper front portion of corresponding intermediate link 13. A tip of a piston rod of each of bucket cylinders 14 is pivoted to an upper rear portion of corresponding intermediate link 13. Each of intermediate links 13 includes a pair of substantially triangular plates. The rear end of bucket link 15, bucket cylinder 14 and lift arm 11 are disposed between the two plates of intermediate link 13 so as to be connected to intermediate link 13.

Bucket link 15 is disposed in the space in intermediate link 13, so as to be easily offset from lift arm 11.

A structure of bucket link 15 and lift arm 11 will be described with reference to FIGS. 7 to 10.

Figure 7:
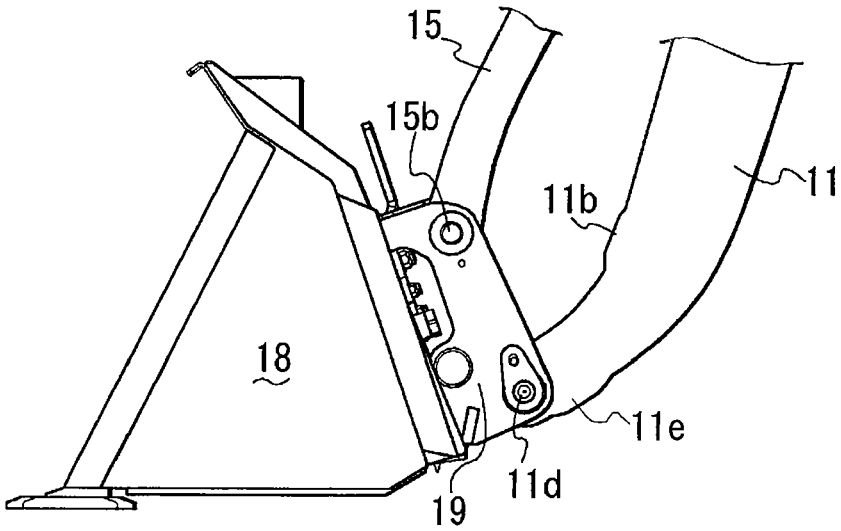
FIG. 7 is a side view of a structure of connecting an attachment.
Figure 8:
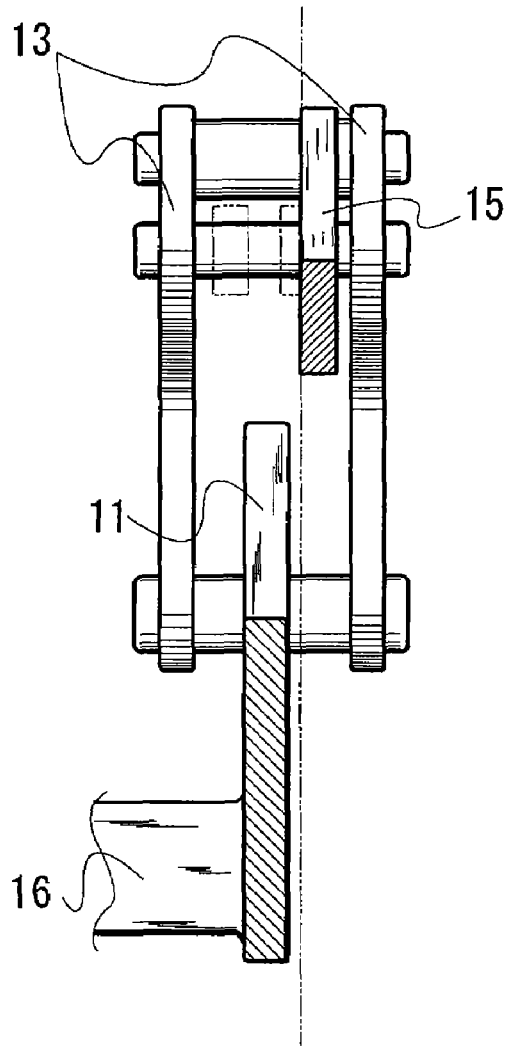
FIG. 8 is a front view partly in section of arrangement of a bucket link and a lift arm.
Figure 9:
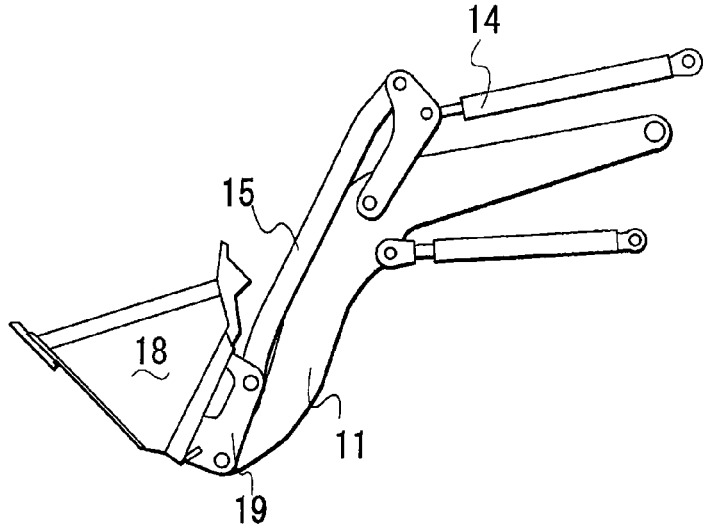
FIGS. 9(*a*) and 9(*b*) illustrate a bucket while it is tilting.
Figure 9:
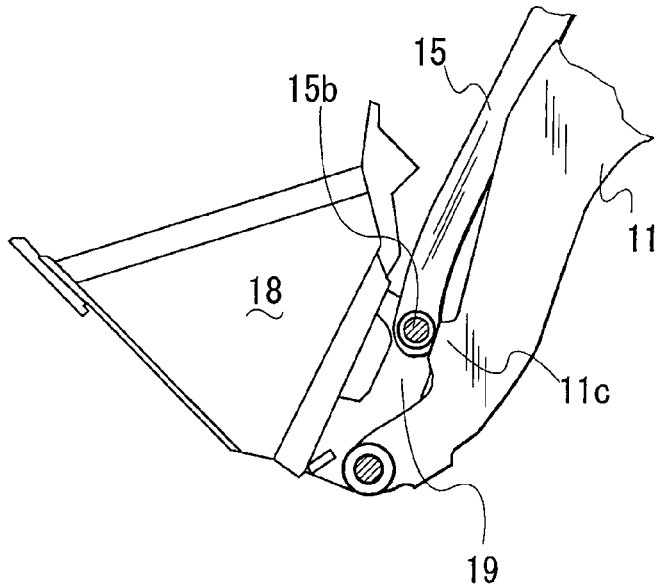

FIG. 7 is a side view of a structure of connecting an attachment. FIG. 8 is a front view partly in section of arrangement of a bucket link and a lift arm. FIG. 9 illustrates a bucket while it is tilting. FIG. 9(*a*) is a side view of the entire loader while the bucket is tilting, and FIG. 9(*b*) is a side view partly in section of a portion of the loader supporting the bucket while the bucket is tilting.

Figure 10:
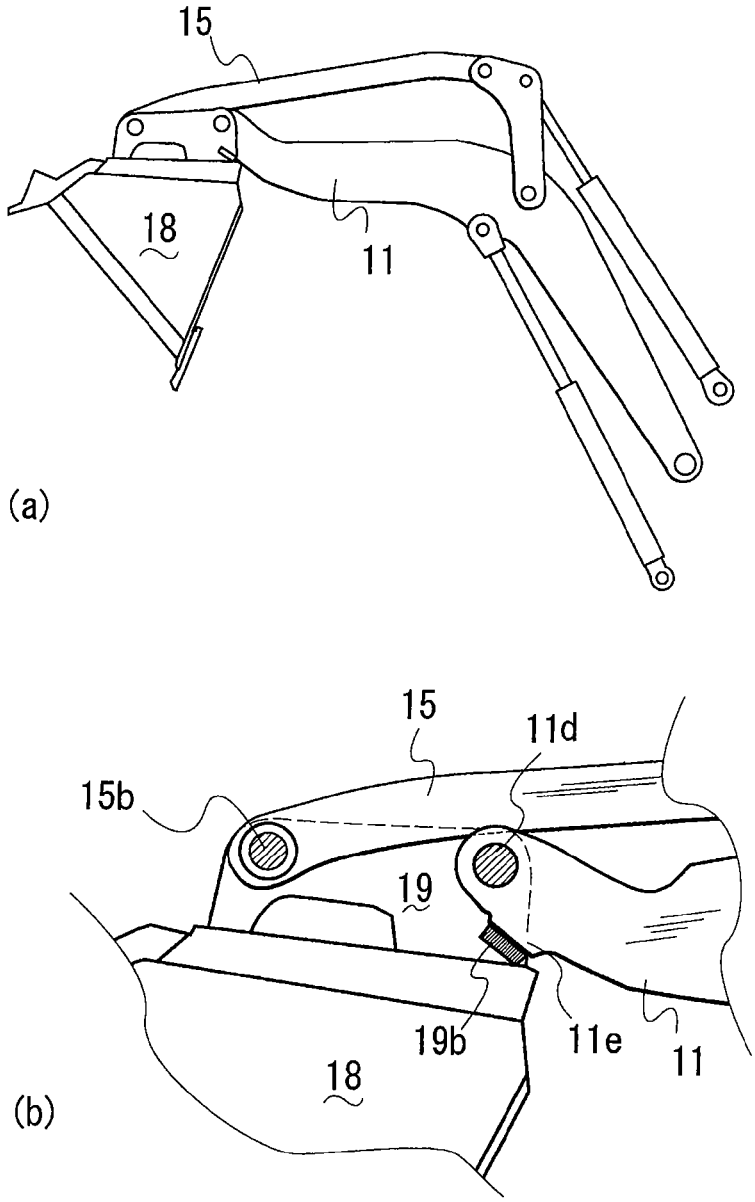
FIGS. 10(*a*) and 10(*b*) illustrate the bucket while it is dumping.

FIG. 10 illustrates the bucket while it is dumping. FIG. 10(*a*) is a side view of the entire loader while the bucket is dumping, and FIG. 10(*b*) is a side view partly in section of the portion of the loader supporting the bucket while the bucket is dumping.

The tip portions of lift arms 11 and the tip portions of bucket links 15 are adapted to support bucket 18. Lift arms 11 and bucket links 15 are pivotally connected to respective attachments 19, and bucket 18 is attached to attachments 19. Each of attachments 19 is connected to corresponding lift arm 11 through pin 11*d*. Each of bucket links 15 is connected to corresponding attachment 19 through pin 15*b*. Pins 11*d* and 15*b* are extended to have lateral axes. Each of pins 11*d* is fitted into attachment 19 and lift arm 11. Each of pins 15*d* is fitted into attachment 19 and bucket link 15. In this way, lift arm 11 and bucket link 15 constitute a parallel linkage. Attachment 19 and intermediate link 13 constitute a parallel linkage. When bucket cylinders 14 are stationary and lift arm cylinders 12 are telescopically moved, bucket 18 is vertically moved while substantially keeping an angle thereof.

Each of lift arms 11 is formed at front portions with a pair of projections, i.e., a lower projection formed on the bottom side so as to serve as a stopper 11*e*, and an upper projection formed on the top side so as to serve as a stopper 11*b*, thereby restricting the rotation of bucket 18.

In loader 2, serving as the loading apparatus, each of bucket links 15 is disposed on the outside of corresponding lift arm 11. Bucket link 15 is offset from lift arm 11 as shown in FIG. 8. Bucket link 15 is disposed so as not to vertically (in a plan view) overlap lift arm 11. Each lift arm 11 is disposed at the lateral middle position between the twin plates of intermediate link 13, each of bucket links 15 is disposed on the outside of lift arm 11 between the twin plates of intermediate link 13.

Therefore, lift arms 11 and bucket links 15 are prevented from interfering with each other during the lifting and swinging of bucket 18. Another design for preventing bucket links 15 from interfering with link arms 11 is unnecessary, thereby increasing the freedom degree in designing bucket links 15 for swinging bucket 18, and ensuring a large rotatable range of bucket 18. Further, each of bucket links 15 can be shaped in a nearly rectilinear shape, such as to be light and simple while ensuring a sufficient rigidity.

Each of lift arms 11 and each of bucket arms 15 are made of plates, so that their lateral widths are small while bucket link 15 overlaps lift arm 11 in a side view during tilting of bucket 18, and that they are rectilinearly connected to each other between corresponding intermediate link 13 and bucket 18, thereby improving the operator's ken for viewing bucket 18 over loader 2. Further, loader 2 is lightened at the side thereof toward bucket 18 so as to reduce the moment applied when bucket 18 is vertically moved.

A structure of the stoppers for limiting the tilting rotation of bucket 18 (in the direction for scooping up) will now be described.

When bucket 18 is rotated toward working vehicle 1 in the state that lift arms 11 are lowered, bucket 18 "tilts", and each of pins 15*b* connecting attachment 19 to bucket link 15 abuts against stopper 11*c* of lift arm 11 so as to limit the tilting rotation of bucket 18. Namely, stoppers 11*c* serve as tilt stoppers.

Due to the above-mentioned offset of bucket links 15 from lift arms 11, stoppers 11*c* come to abut against respective pins 15*b* without interference of lift arms 11 with bucket links 15. Each of lift arms 11 is formed integrally with stopper 11*c*, thereby providing simple and durable stopper 11*c*.

A structure of the stoppers for limiting the dumping rotation of bucket 18 (in the direction for dumping) will now be described.

Each of stoppers 11*e* is formed on the bottom surface of the tip portion of lift arm 11 so as to have a downward projecting flat surface. When bucket 18 is rotated opposite to working vehicle 1 in the state that lift arms 11 are lowered, bucket 18 "dumps", and each of stoppers 19*b* of attachments 19 abuts against stopper 11*e* of lift arm 11 so as to limit the dumping rotation of bucket 18.

Each of stoppers 19*b* is extended laterally from a bracket of attachment 19 supporting pins 11*d* and 15*b*. When bucket 18 dumps, a flat surface of each of stoppers 19*b* abuts against the flat surface of corresponding stopper 11*e* of lift arm 11.

Due to the offset of bucket links 15 from lift arms 11, stoppers 11*e* come to abut against respective stoppers 19*b* without interference of lift arms 11 with bucket links 15. Namely, stoppers 11*e* serve as dump stoppers.

Each of lift arms 11 is formed integrally with stopper 11*e* for limiting the rotation angle of bucket 18, thereby providing simple and durable stopper 11*e*.

A structure of bucket cylinders 14 will now be described.

Figure 11:
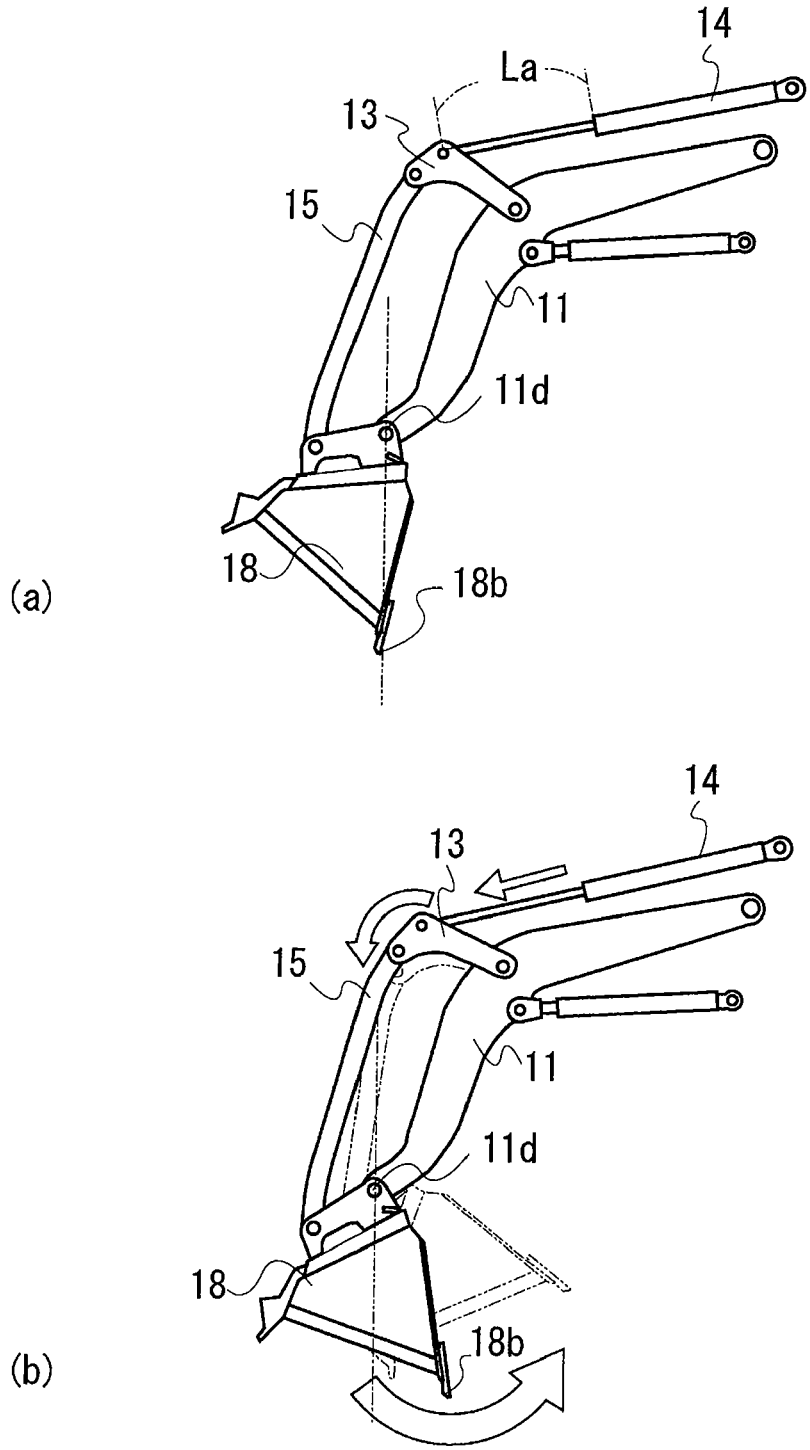
FIGS. 11(*a*) and 11(*b*) illustrate a bucket cylinder when its stroke is determined.

FIG. 11 illustrates a bucket cylinder when its stroke is determined. FIG. 11(*a*) is a diagram of the bucket cylinder whose stroke reaches the maximum. FIG. 11(*b*) is a diagram of the bucket cylinder when the bucket is excessively rotated.

In the state that lift arms 11 have been rotated downward, the downward rotation of bucket cylinders 14 is limited at a position where pawls 18*b* provided on the bottom edge of bucket 18 are disposed just under respective pins 11*d*, so as to prevent pawls 18*b* from further moving toward working vehicle 1. In this regard, the maximum stroke of each of bucket cylinders 14 has a length La when lift arms 11 are lowered and pawls 18*b* reach the position just below pins 11*d*. To limit the stroke of each of bucket cylinders 14, a stopper may be provided on the rod of bucket cylinder 14, so that, when the cylinder abuts against the stopper, the stroke of the cylinder is defined as the maximum stroke, and prevented from exceeding length La.

Therefore, bucket cylinders 14 are prevented from receiving excessive load when bucket 18 is pressed against the ground surface and the loader is used for lifting up the working vehicle. If the vehicle is lifted up by the loader in the state that bucket 18 is disposed so as to rotate pawls 18*b* toward the vehicle from the position just below pins 11*d*, it is suggested that the weight of the vehicle and the working shock are transmitted to bucket cylinders 14 so as to cause a leak of fluid from bucket cylinders 14. In this regard, with respect to the angle of bucket 18, the force is gradually applied as bucket 18 is rotated toward the working vehicle. The force is transmitted through bucket links 15 to bucket cylinders 14 so as to extend the rods of bucket cylinders 14, so that bucket cylinders 14 may be excessively loaded and damaged when they are extended.

EMBODIMENT 2

A second embodiment of the invention will be described with reference to FIGS. 12 and 13.

Figure 12:
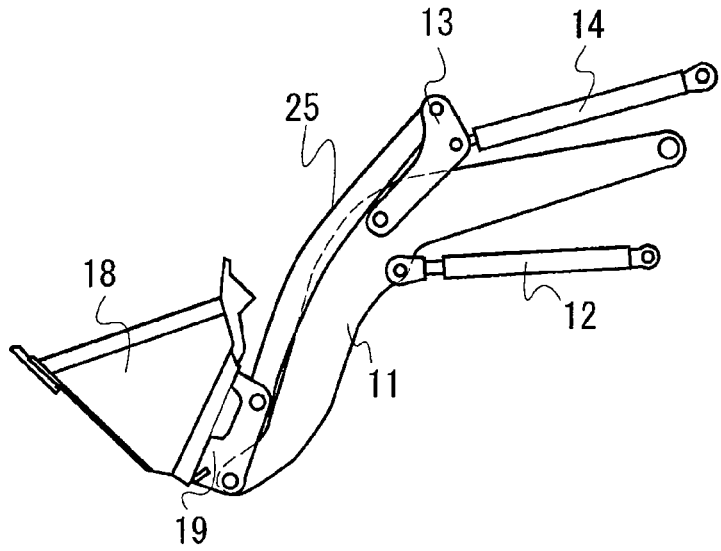
FIGS. 12(*a*) and 12(*b*) illustrate a bucket link according to a second embodiment.
Figure 12:
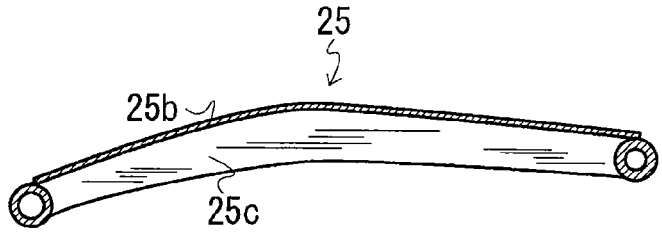
Figure 13:
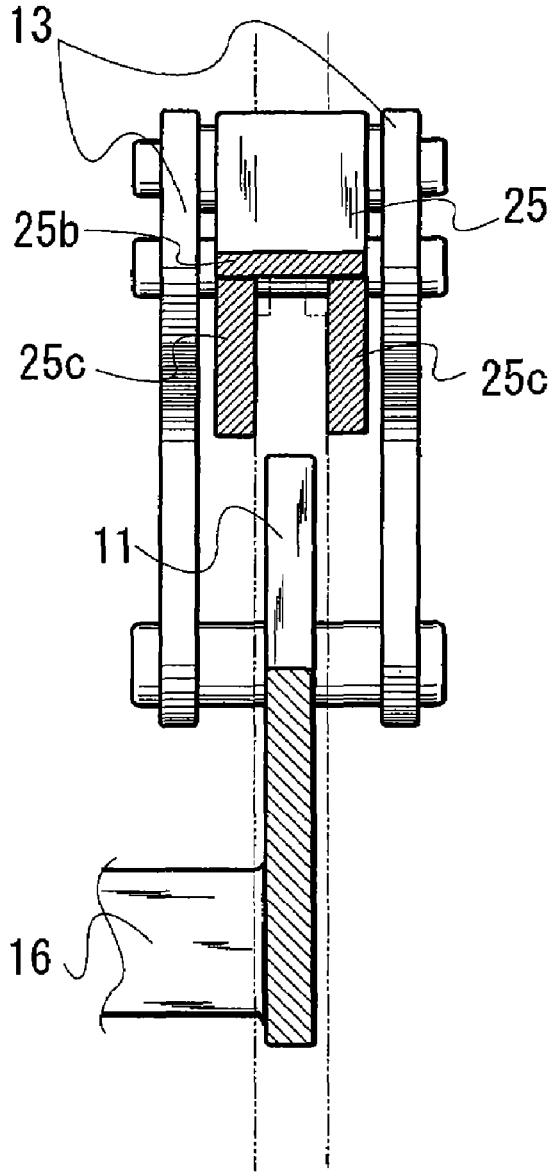
FIG. 13 is a front view partly in section of the bucket link according to the second embodiment.

FIG. 12 illustrates a bucket link according to a second embodiment. FIG. 12(*a*) is a side view of a loader according to the second embodiment, and FIG. 12(*b*) is a side view partly in section of the bucket link. FIG. 13 is a front view partly in section of the bucket link according to the second embodiment.

Each of bucket links 25 has a not-pivoted portion sectionally formed in a reversed U-shape when viewed in front. Referring to FIG. 13, in the reversed U-shaped section, a pair of plates 25*c* are extended downward from a bottom surface of a horizontal plate 25*b*. Each of lift arms 11 is disposed between the downwardly extended plates. Such a bucket link 25 is improved in strength while it is prevented from interfering with lift arm 11. Further, the sectional area of bucket link 25 for ensuring the rigidity is increased while bucket link 25 is vertically minimized. Therefore, the freedom degree of designing the linkage for swinging the bucket is enhanced.

Alternatively, a bucket link may be T-shaped in a sectional front view.

What is claimed is:

1. A loading apparatus comprising:

a bracket fixed on a vehicle;

a lift arm pivoted at one end thereof onto the bracket;

a lift arm cylinder interposed between the bracket and the lift arm and adapted to be telescoped for vertically swinging the lift arm relative to the bracket;

an attachment vertically swingably pivoted onto a tip portion of the lift arm;

an intermediate link pivoted on an intermediate portion of the lift arm;

a bucket cylinder interposed between the intermediate link and the bracket and adapted to be telescoped for vertically swinging the attachment relative to the lift arm; and a bucket link interposed between the intermediate link and the attachment so as to transmit the telescopic movement of the bucket cylinder to the attachment, wherein the bucket link is disposed above the lift arm, wherein the intermediate link includes a pair of left and right plates, so that a rear end portion of the bucket link is pivoted to an upper front portion of the intermediate link between the plates, a tip portion of a piston rod of the bucket cylinder is pivoted to an upper rear portion of the intermediate link between the plates, and a fore-and-aft middle portion of the lift arm is pivoted to a bottom portion of the intermediate link between the plates, wherein the lift arm is disposed at a lateral middle position between the plates of the intermediate link, wherein the bucket link is disposed between the plates of the intermediate link and offset laterally outward from the lift arm side so as not to vertically overlap the lift arm, wherein the lift arm and the bucket link are made of plates, wherein the bracket is a pair of left and right brackets fixed on the vehicle, wherein the bucket cylinder is a pair of left and right bucket cylinders, the lift arm is a pair of left and right lift arms, and the lift arm cylinder is a pair of left and right lift arm cylinders provided on the vehicle, wherein each of the bucket cylinders, each of the lift arms and each of the lift arm cylinders are pivoted at respective rear ends thereof to each of the brackets, wherein, in each of the brackets, a pivot center of the lift arm is disposed forward and downward from a pivot center of the bucket cylinder, wherein, in each of the brackets, a pivot center of the lift arm cylinder is disposed forward and downward from the pivot center of the lift arm, and wherein a stopper is provided on each of the lift arms so as to limit the rotation of a bucket attached to the attachment.

* * * * *